US005652974A

United States Patent [19]

Demar

[11] Patent Number: 5,652,974

[45] Date of Patent: Aug. 5, 1997

[54] DEVICE FOR IMPROVING THE FLUSHABILITY OF TOILETS AND CONSERVING WATER

[76] Inventor: Charles J. Demar, 16 Ridge Way, Purdys, N.Y. 10578

[21] Appl. No.: 531,919

[22] Filed: Sep. 21, 1995

[51] Int. Cl.[6] ..... E03D 11/11

[52] U.S. Cl. ..... 4/661; 4/231; 4/420

[58] Field of Search ..... 4/231, 300.3, 415, 4/420, 421, 661

[56] References Cited

U.S. PATENT DOCUMENTS

| | | | |
|---|---|---|---|
| 294,758 | 3/1884 | Catlin | 4/231 |
| 1,202,822 | 10/1916 | Ferriss | 4/231 |
| 3,723,998 | 4/1973 | Wehr | 4/300.3 |
| 4,050,101 | 9/1977 | Logue | 4/300.3 |
| 5,335,379 | 8/1994 | Waldo | 4/661 |

FOREIGN PATENT DOCUMENTS

| | | | |
|---|---|---|---|
| 0241344 | 10/1925 | United Kingdom | 4/231 |
| 0288878 | 4/1928 | United Kingdom | 4/231 |

*Primary Examiner*—Robert M. Fetsuga
*Attorney, Agent, or Firm*—Martin J. Spellman, Jr.

[57] ABSTRACT

A water diverter for installation in a flush toilet bowl includes a cylindrical body having a cone-shaped end with a chain attached to the peak of the cone. The chain includes a clip that can be inserted into a water distribution port of a rim of the toilet. The body may be hollow to contain disinfectant and have inlet and outlet holes therein. Alternate embodiments are disclosed.

2 Claims, 6 Drawing Sheets

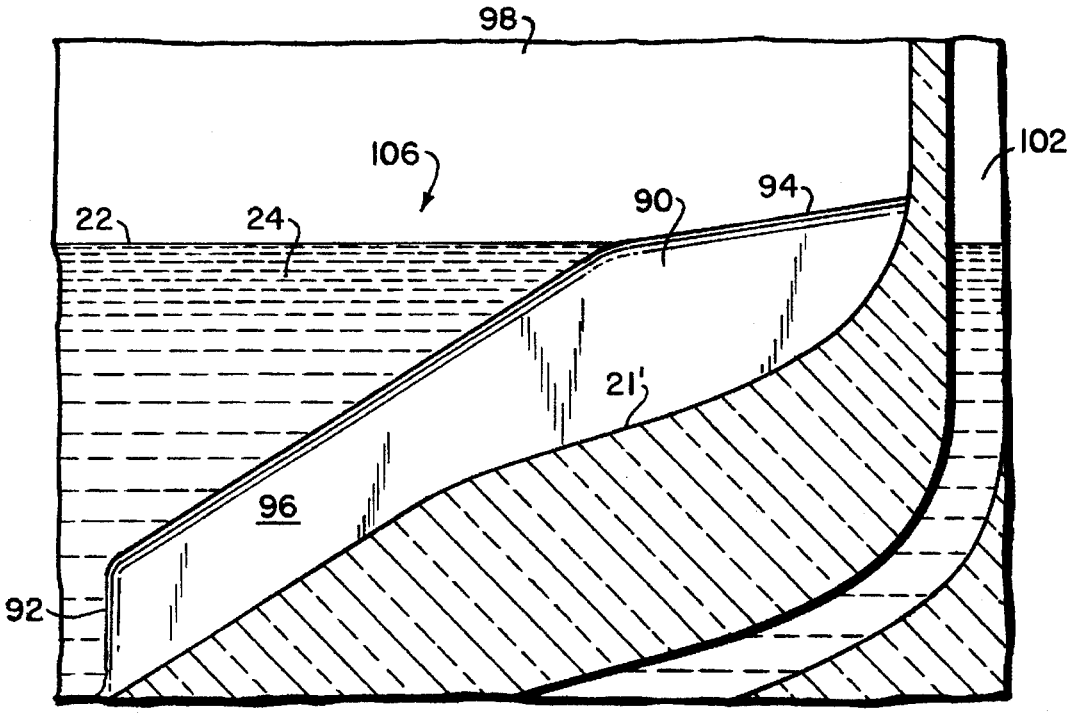
FIG.13
FIG.14
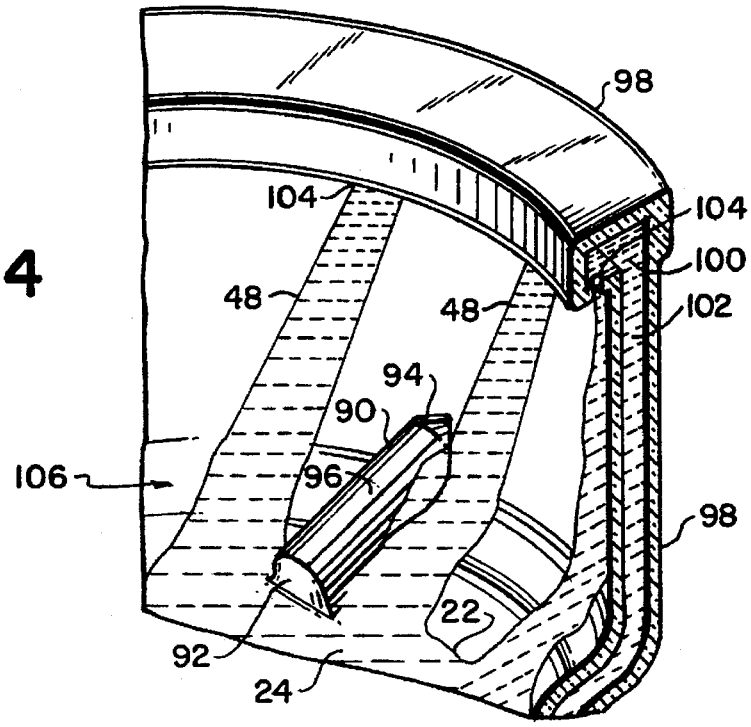

DEVICE FOR IMPROVING THE FLUSHABILITY OF TOILETS AND CONSERVING WATER

BACKGROUND OF THE INVENTION

1. Field of the Invention

This invention pertains to toilet bowls and specifically to an attachment for toilet bowls to improve flushability and save on the amount of water required for flushing. The invention includes such improvement toilet bowls in the form of the attachment integrally molded into toilet bowls to obtain the foregoing ends.

It is known that a considerable amount of water is used each time that a toilet is flushed. It is desirable that the toilet be able to flush as soon as possible and to fully clean out the bowl. This invention concerns an addition to the toilet bowl as well as improved toilet bowl design which serves to deflect the swirling water downwardly towards the drain outlet, shortening the time required to obtain a flush, and decreasing the amount of necessary water required to obtain a full flush of the toilet bowl.

In the past it has been considered that the more water stored in the water closet or toilet the more complete the flushing action. It is well known, however, that often there is a considerable amount of time before a toilet flushes, even though a large amount of water has been added to the bowl without establishing a flushing action. Older toilets use up to four cubic feet of water. More modern toilets have water tanks holding approximately two cubic feet of water. Thus, up to five to six gallons of water are being utilized for each flush of conventional modern toilets. Toilets are commonly designed to have one or more inlet conduits in the side of the rim or under the rim of the circular bowl area and directed so as to provide a generally swirling pattern in the bowl of the water coming from the storage tank. The intent is to keep the interior of the bowl generally clean, providing a more sanitary interior bowl.

2. Prior Art

It is known in the prior art, particularly in U.S. Pat. No. 4,050,101 Logue, to place a permanent baffle on the inclined front interior wall of the toilet bowl to terminate or reduce the swirling action of the water and direct the water down towards the exit conduit so as to generally save water. This also envisions a permanently located baffle. In this case, the baffle is cemented with a water insoluble cement and results in a saving of forty to fifty percent of water.

In U.S. Pat. No. 3,723,887 Wehr a flat deflector plate which extends downwardly from the peripheral rim to direct water toward the outlet and reduce the quantity of water required in flushing is disclosed. The edge of the plate is shaped complementary to the toilet bowl wall.

U.S. Pat. No. 4,050,101 Logue shows a baffle for a toilet bowl comprising a curved baffle which is positioned below the normal water level for swirling water directly into the outlet conduit. The purpose in this case is to save water.

In U.S. Pat. No. 2,689,353 Schuster a water closet is disclosed having a beam running longitudinally across the toilet bowl at just about the water line to prevent splashing when the toilet is being used. There is no discussion of the function of causing turbulence or directing water down to the exit conduit.

U.S. Pat. No. 2,121,940 Wolff is of background interest to demonstrate the utilization of baffles in toilet bowl arrangements to generate a turbulence to enhance cleansing during flushing.

SUMMARY OF THE INVENTION

In accordance with the present invention, a greatly improved turbulator system or water diverter which may be installed in existing toilet bowls with no tools at all and is extremely effective, sanitary, and results in being able to adapt all existing toilets to flush quicker and conserve energy without utilization of any tools or modification of the existing toilet structure or any permanent attachments to the toilet.

The diverter of the present invention can be molded into new toilet bowl structures. The device of the present invention includes a cylindrical shaft of a plastic material having approximately one inch to two inches in diameter, of cylindrical shape, and approximately six to eight inches long. One end of the cylinder has a means of securing it to the underside of the toilet bowl lip in a removable manner. Typical of commercial plastics that are preferred because of their inertness, smooth surface, resistance to color change and chipping are acrylics such as methyl methacrylate, available as Lucite®, and polycarbonate.

The upper end of the cylinder has a ring means or similar fixture molded into it with chain or other securing means with a hook at the end of it for securing the device to the under lip of the toilet at the forward side by retention in a water dispersion hole, for instance.

Within the scope of the invention there it is also envisioned to provide a bracket which clips over the edge of the toilet with a means for securing the chain means attached to the proximal end of the device. The materials utilized must be resistant to rust and the contamination of waste materials deposited into the toilet.

The device is placed at the front end of the toilet, laying against the inner surface of the front of the bowl and preferably is adjusted so that a little more than one-half is submerged in the resting water of the toilet bowl.

It should be long enough to prevent it from making the turn and going down the drainpipe and dense enough not to be moved away by the water swirl.

The chain or the clip at the end of it can be made of adjustable length so that the placement of the cylindrical body on the front end of the toilet bowl can be adjusted up or down, depending upon the particular curvature, incline, and depth of the water and height of the toilet bowl to obtain the optimum conditions. A significant portion of the water is diverted downwardly towards the outlet conduit and this causes the toilet to flush much sooner with much less water required.

In an alternative embodiment the cylinder is constructed with a hollowed out core and with the proximal cone end serving as a cap to enclose the interior of the cylinder. It is provided with internal threads which are utilized so as the external surfaces are smooth. A capillary hole is provided in the base of the cylinder and a larger hole in the side of the cylinder adjacent to the proximal end. The cylinder is then filled with disinfecting fluid usually with a bluish hue to it and upon flushing of the toilet drops of the fluid are dispersed into the bowl of water with their volume replaced with bowl water going into the upper hole.

Further embodiment of the device includes molding a hump into the front end of the toilet bowl rising approximately one and one-half inches and shaped to conform to the shape of the cylinder The device of the present invention is a significant improvement over prior art devices since it is installed with virtually no tools, is designed so that no waste matter will be retained on it, easily flowing off of it. Inert materials are utilized to prevent rust and other corrosion from toilet cleaners and waste material.

BRIEF DESCRIPTION OF THE DRAWING

In the accompanying drawing which forms a part of specification:

FIG. 13 is a side view of the forward end of the toilet bowl, partially in section, showing a side elevational view of integrally molded device of the present invention comprising part of the forward wall of the toilet bowl;

FIG. 14 is a perspective view of the embodiment shown in FIG. 13 and also showing the flow of the water from force in the rim of the bowl.

ILLUSTRATIVE SPECIFIC EMBODIMENT

Figure 1:
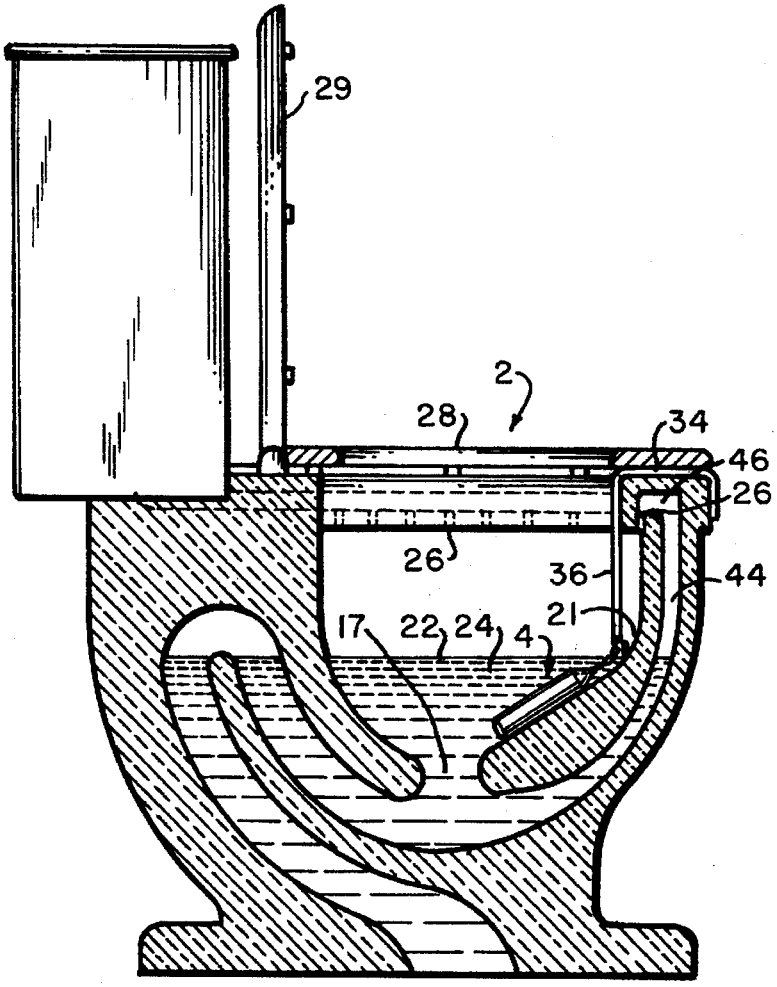
FIG. 1 is a side view of a typical toilet with storage tank section through the longitudinal axis of the bowl.
Figure 2:
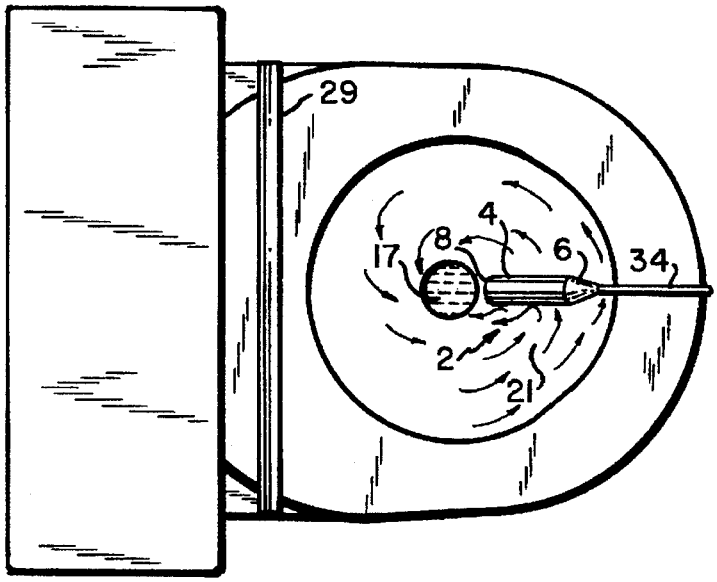
FIG. 2 is a top plan view of the toilet shown in FIG. 1 showing the device of the present invention in place, but with the toilet seat removed.
Figure 3:
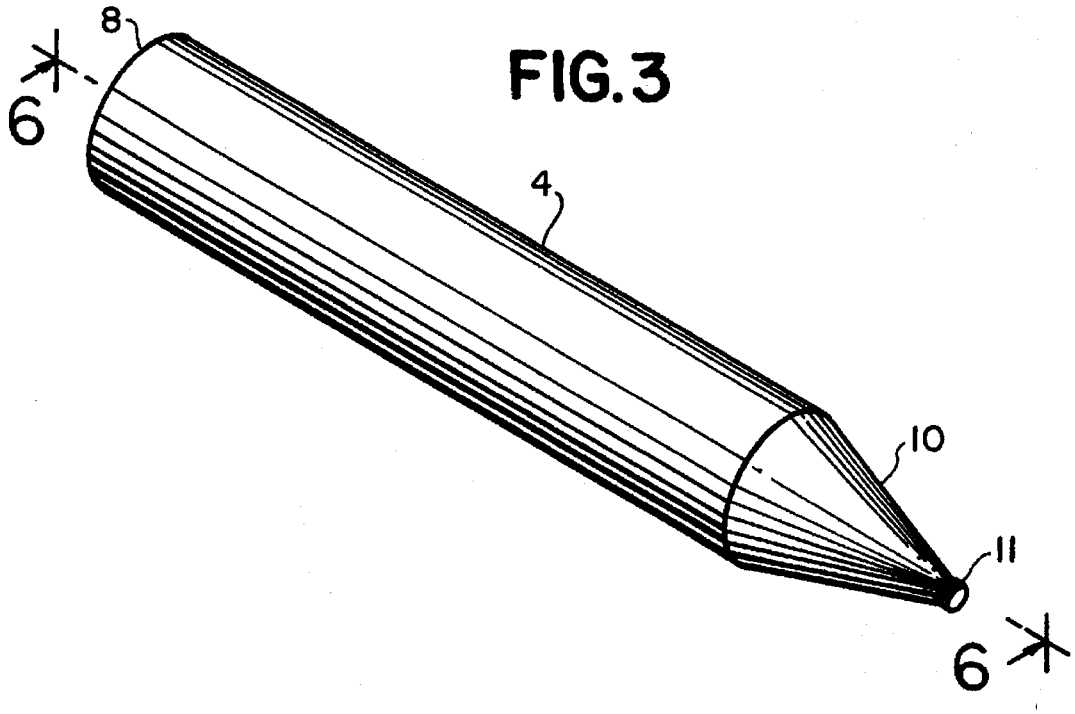
FIG. 3 is a perspective view of the device of the present invention showing a clear plastic cylinder.
Figure 4:
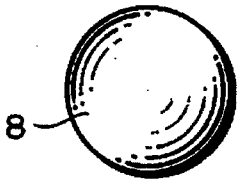
FIG. 4 is a end elevational view thereof.
Figure 5:
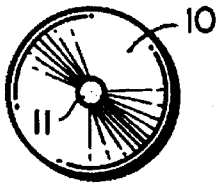
FIG. 5 is an end view of the proximal end of the cylinder.
Figure 6:
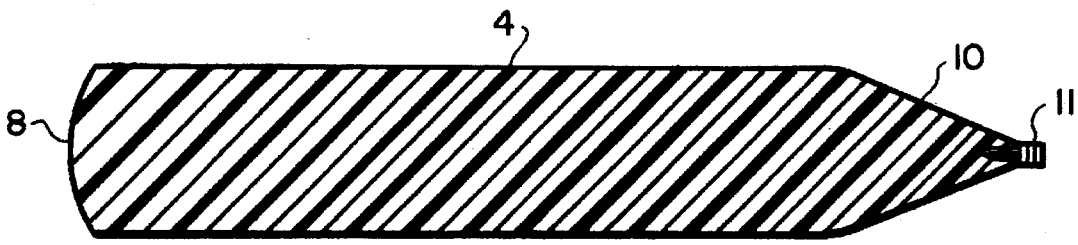
FIG. 6 is a sectional view along lines 6—6 of FIG. 3.
Figure 7:
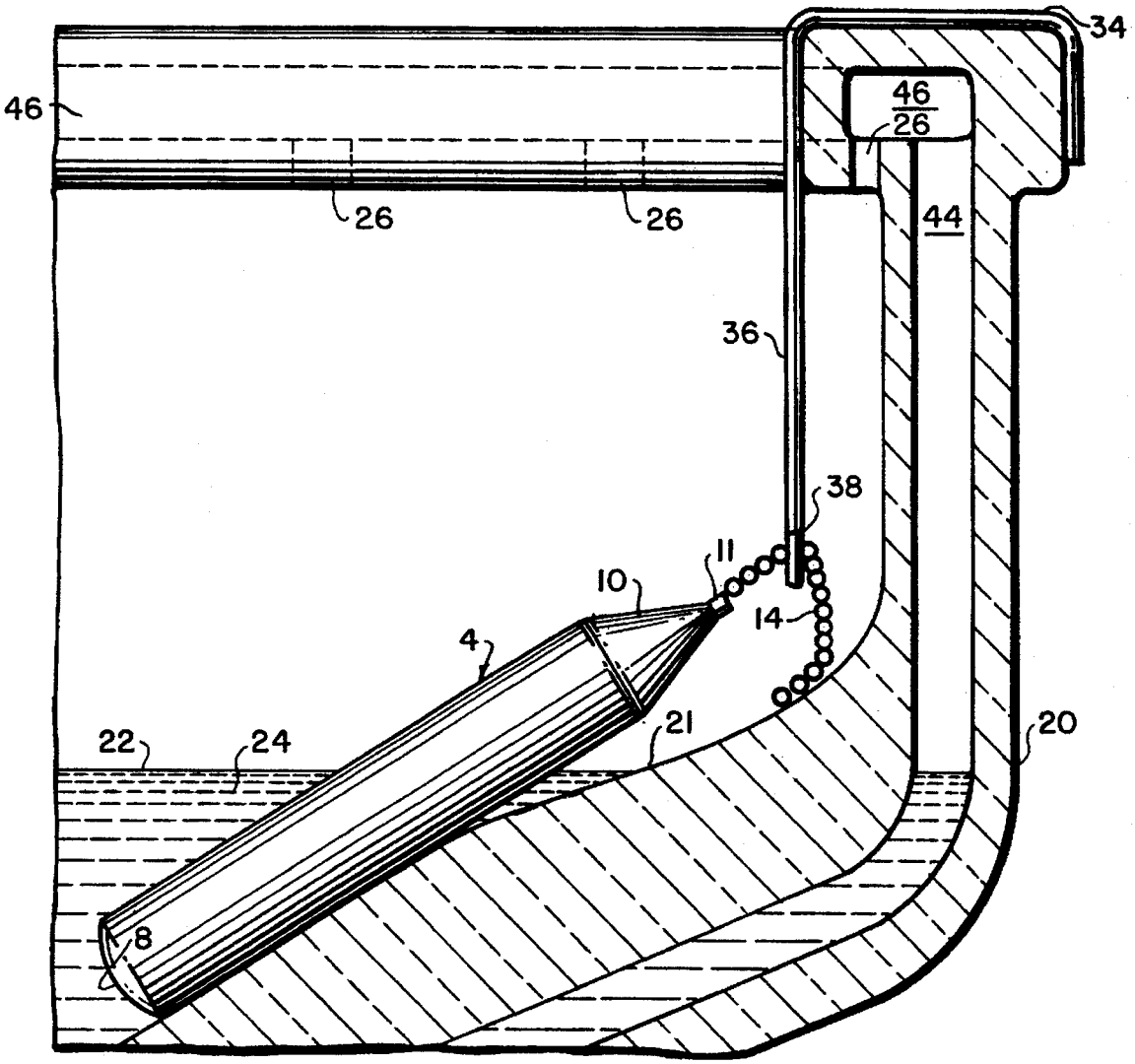
FIG. 7 is an enlarged partial view of the device of the present invention placed in the toilet bowl which is shown partially in section.

In the accompanying drawing in FIG. 1 a typical toilet 2 is shown with the device 4 of the present invention in place.

The device 4 comprises a cylindrical body having a proximal end 6 and a distal end 8. The proximal end 6 in the embodiment shown has a tapered cone form 10 with a screw 11 for securing a beaded chain 14 thereto. The opposite end of the chain 14 is provided with a hook or clip 16 and extension 18.

The toilet 2 includes a seat 28 and usual seat cover 29 therefore. The forward interior wall of the toilet is indicated at 21 and the usual standing water in the toilet 2 is indicated at 24 with the top surface 22. The outlet 17 is at the base of the bowl 20.

Figure 10:
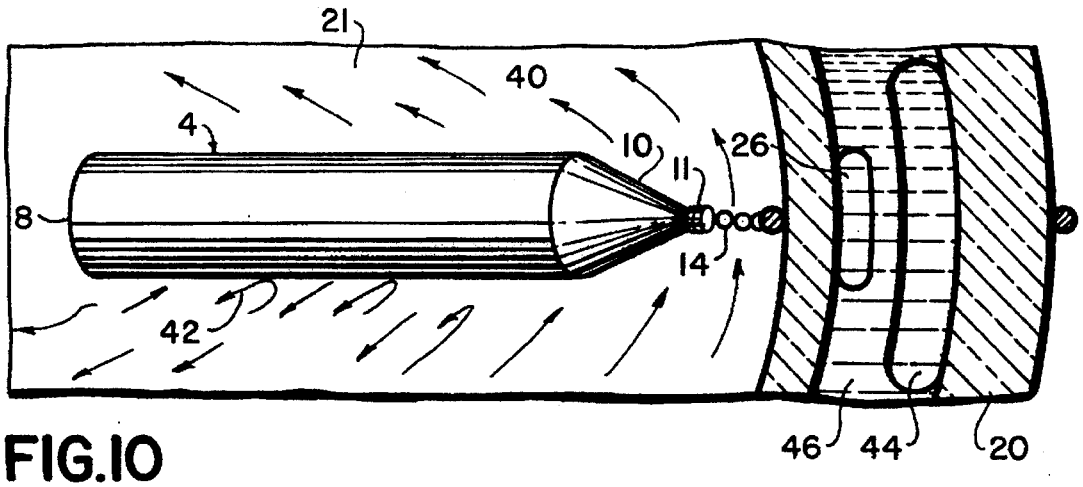
FIG. 10 is a top view, partially in section, of the device as shown in FIG. 9 with the forward wall of the toilet bowl shown in section.

In the embodiment shown in FIGS. 1 and 10 a wire bracket 34 sized to resiliently fit over the rim of the toilet 2 has the inner arm 36 extending downwardly as shown. The base of the arm 36 has an aperture provided therein for securing the chain 14 to it. Channel 44 in the bowl 20 is connected to the water supply and is in flow communication with the downward extending outlet ports 26.

The outlet ports 26 are shown schematically as a rectangular shape. In practice they are formed at a slanted angle to create a left or right swirling action when the toilet 2 is flushed.

Figure 8:
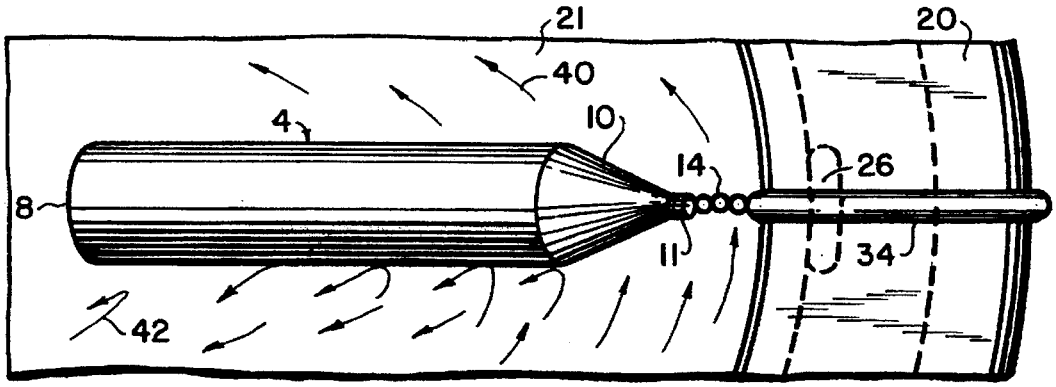
FIG. 8 is a top plan view of the device in place in FIG. 7 with a schematic indication of the flow of water during flushing sequence.
Figure 9:
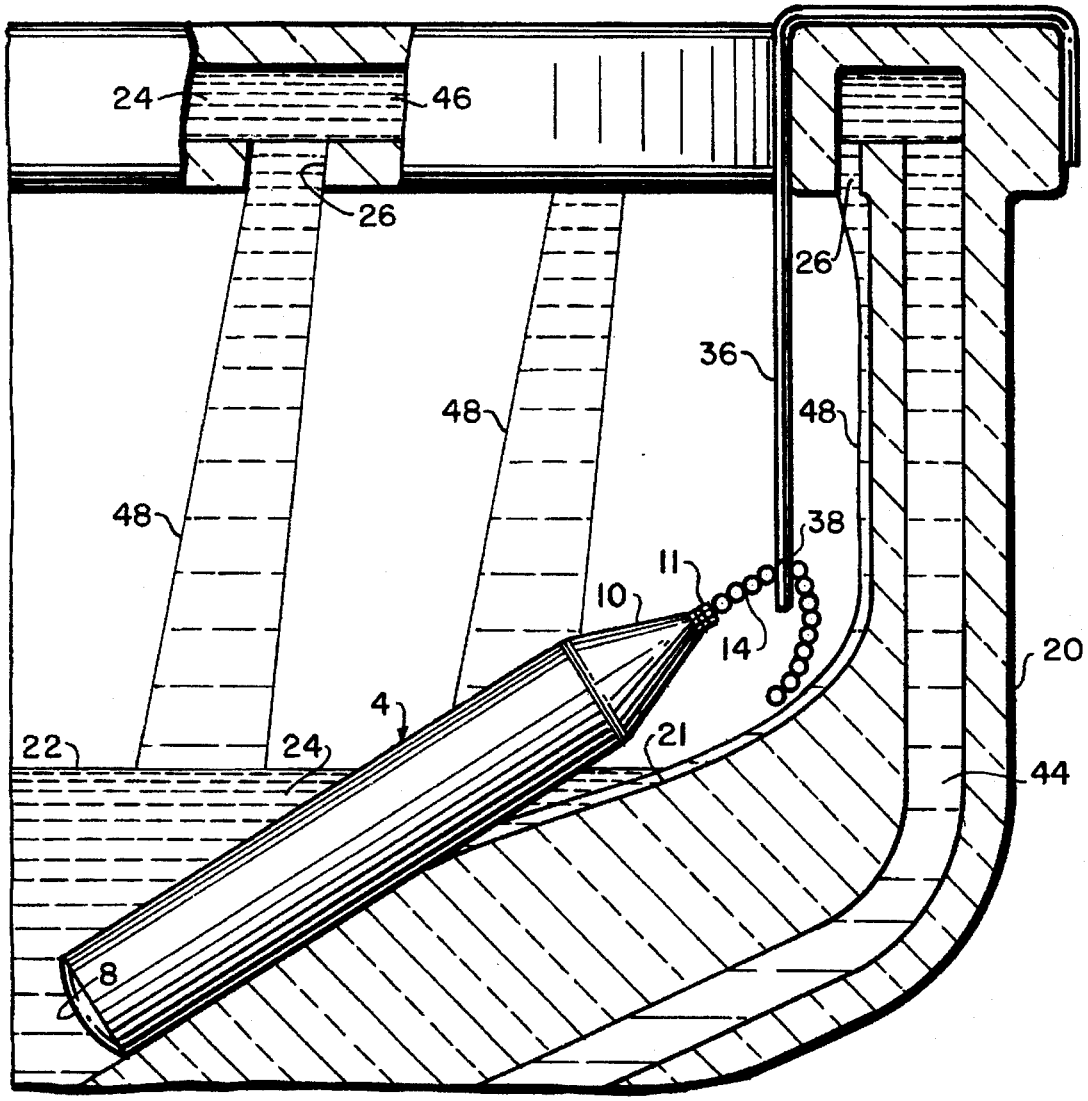
FIG. 9 is a side view partially in section, similar to FIG. 7 showing schematically representation of the angular of flow of water from the rim of the toilet.

When using the device 4 of the present invention, as the toilet 2 is flushed the initial swirling of the water is indicated at 40 in FIG. 8, however, as it comes around and is interfered with by the device 4 it is diverted away as indicated at 42 and directed downwardly towards the outlet 17. This causes the toilet 2 to flush much sooner and to flush with the consumption of much less water than normal.

Figure 11:
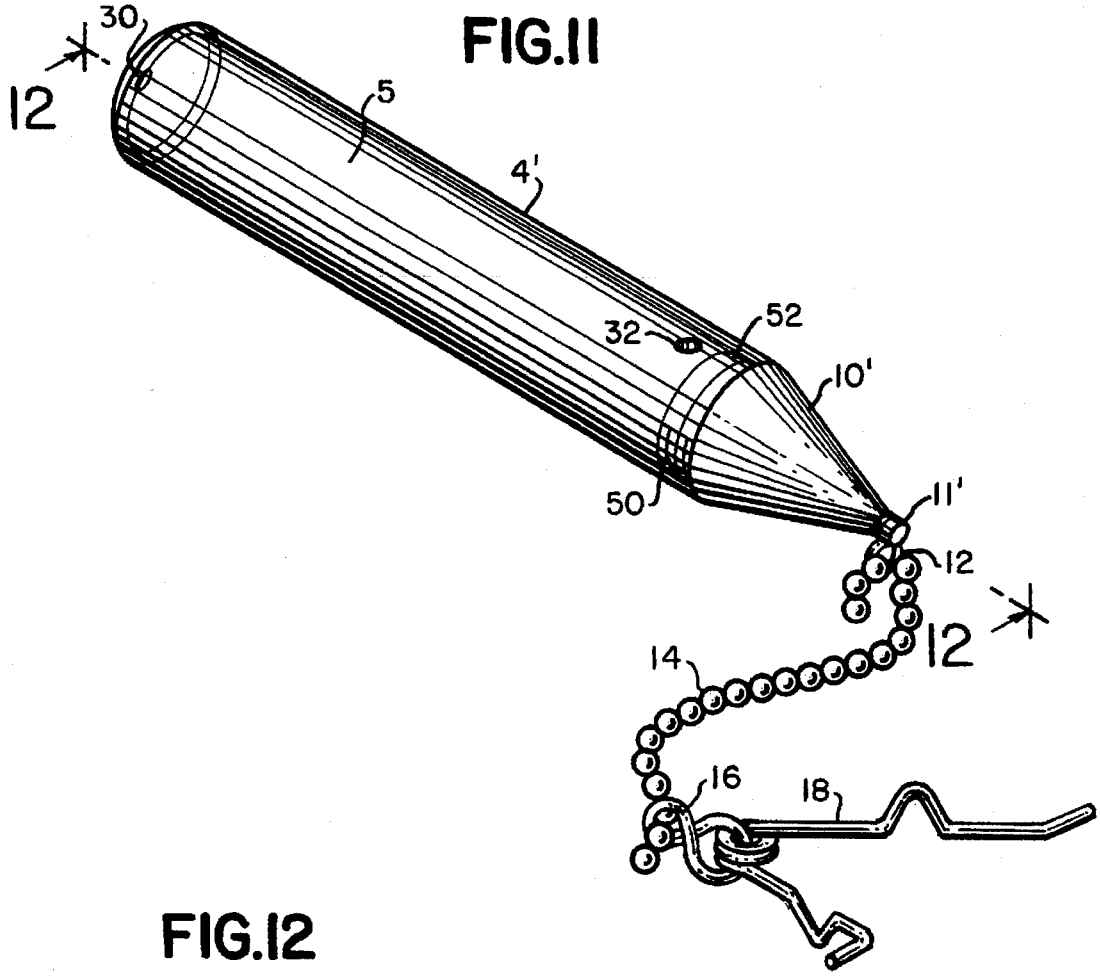
FIG. 11 is a perspective view of the device showing a clip means for installing it in the outlets.
Figure 12:
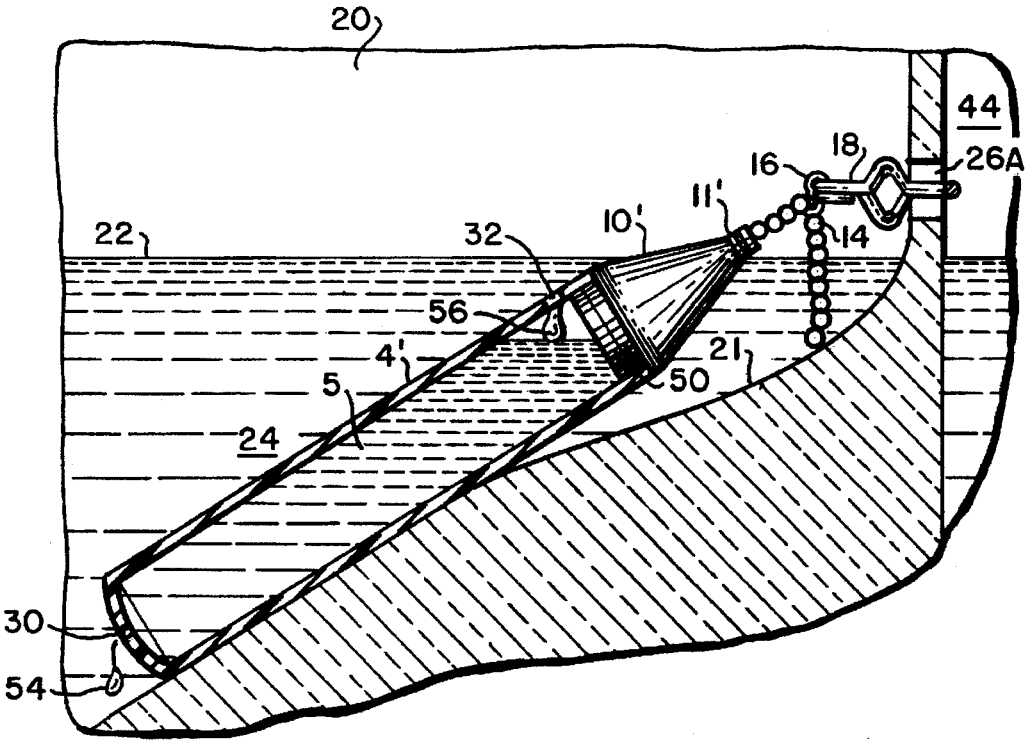
FIG. 12 is a side view partially in section showing the device of the present invention molded in the side/forward wall of the toilet bowl.

An alternate embodiment of the device is shown in FIG. 11. The cylindrical device 4' is hollow and has an end cap the cone shaped 52 with internal threads 50 cooperating with threads on the interior of the cylinder 4' as shown schematically. The device 41 has an aperture 32 at the top thereof and a smaller aperture 30 at the base 8 thereof. The interior may be filled with disinfecting fluid which is typically colored blue. The holes 30 and 32 are designed so that if the toilet is flushed a little amount of disinfecting fluid is metered out at 30 in the form of a drop 54 as indicated. Volume is replaced by corresponding drops 56 as the toilet 2 is flushed and the water rises as shown in FIG. 12. In the absence of overhead pressure from the opening 32 the capillary size of the opening 30 is small enough to prevent the flow of fluid in the absence of additional pressure. The disinfecting fluid is indicated at 5 in FIG. 20.

Also shown in this embodiment of the device 4' is a modification of the clip 16 which can be fitted into the side opening 20' in the toilet rim indicated at 26A.

In FIGS. 13 and 14, an alternate embodiment of the device as shown in this case cut away toilet bowl 98 having an external channel 102 as shown. A device 90 of present invention is molded into the front wall 21' of the toilet bowl 98 and includes the generally cylindrical body 96 having a distal end 92 and a canted upper end 94 which blends into the inner front wall 21' of the toilet. When the toilet in this case is flushed, the outer channel area 102 is filled with water which flows from the outlets 104 in the rim 100 in offset streams 48 and has the same effect are in the prior embodiment to empty the interior 106.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A water diverter for installation in a flush toilet, said diverter comprising a cylindrical plastic body from one to two inches in diameter and from six to eight inches in length, the diverter having a dorsal end portion and a proximal end portion, the proximal end portion having a generally cone shape, the peak of said cone having a retaining device therein connected to one end of a chain, a remote end of said chain having a clip means secured thereto, said clip means adapted to releasably be retained in distribution ports of a rim of the toilet.

2. A diverter device as claimed in claim 1 wherein said cylindrical body is hollow, has a capillary size aperture in the dorsal end portion thereof, and a larger aperture adjacent the proximal end portion thereof, said proximal end portion cone shape being defined by a cone shaped body having internal threads thereon, an internal surface of such cylindrical body having matching threads, said device being adapted to contain and dispense a disinfecting fluid.

* * * * *